US005787953A

United States Patent [19]

Jacobson

[11] Patent Number: 5,787,953

[45] Date of Patent: Aug. 4, 1998

[54] CORDLESS APPARATUS FOR OPERATING BLINDS AND SHADES

[76] Inventor: Jeff A. Jacobson, 4508 Dorchester Rd., Corona Del Mar, Calif. 92625

[21] Appl. No.: 855,797

[22] Filed: May 12, 1997

[51] Int. Cl.[6] ..... E06B 9/30

[52] U.S. Cl. ..... 162/168.1 R; 160/84.04; 160/173 R; 74/127

[58] Field of Search ..... 160/168.1 R, 168.1 V, 160/176.1 R, 176.1 V, 178.1 R, 178.1 V, 173 R, 173 V, 177 R, 177 V, 84.04, 900, 107, 170 R, 171 R, 104; 74/127; 192/7

[56] References Cited

U.S. PATENT DOCUMENTS

| | | | |
|---|---|---|---|
| 1,422,411 | 7/1922 | Bordick | 74/127 |
| 1,445,133 | 2/1923 | Drake | 74/127 X |
| 1,838,957 | 12/1931 | Orawiec | 74/127 |
| 2,455,434 | 12/1948 | Mikelson | 74/127 |
| 4,759,398 | 7/1988 | Renee . | |
| 4,817,698 | 4/1989 | Rossini et al. . | |
| 5,476,132 | 12/1995 | Jacobson . | |

*Primary Examiner*—Blair Johnson
*Attorney, Agent, or Firm*—Oppenheimer Wolff & Donnelly LLP

[57] ABSTRACT

Apparatus for cordless operation of blinds and shades. A pair of actuators are in spiral engagement with a spiral wand coupled to a rail mechanism from which the blinds or shades depend. Each actuator is biased into driving engagement with the wand, one of the actuators rotating the wand in one direction when raised or lowered and the other actuator rotating the wand in the opposite direction when raised or lowered.

14 Claims, 3 Drawing Sheets

FIG. 3
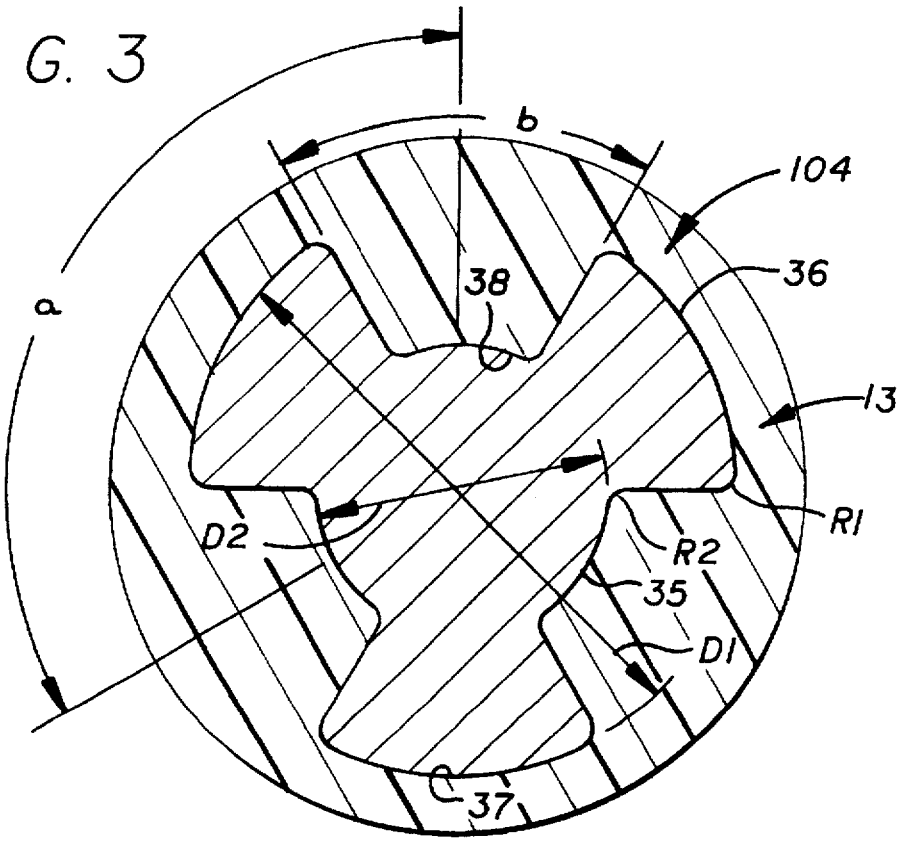
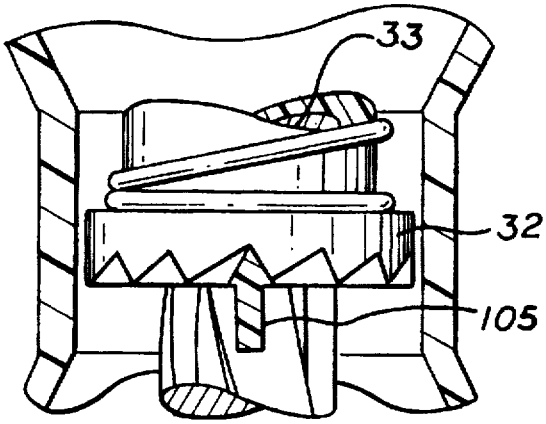
FIG. 4
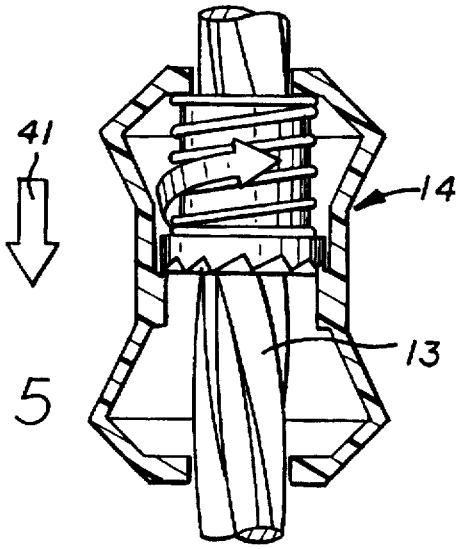
FIG. 5

CORDLESS APPARATUS FOR OPERATING BLINDS AND SHADES

BACKGROUND OF THE INVENTION

FIELD OF THE INVENTION

In my U.S. Pat. No. 5,476,132, the teachings of which are incorporated herein, I disclose apparatus for cordless operation of blinds comprising a pair of actuators in spiral engagement with a spiral wand coupled to rail mechanism from which the blinds depend. One of the actuators rotates in one direction and the other actuators rotate in an opposite direction. Raising or lowering selective ones of the actuators operates the blinds.

In this patent, the actuators bearing assemblies including a pair of drive nuts in driving engagement with the wand. The drive nuts disclosed in my U.S. Pat. No. 5,476,132 patent are actuated by a plurality of rollers in tight fitting driving relationship to the other surface of the drive nut.

Although the bearing assemblies disclosed in my U.S. Pat. No. 5,476,132 patent are efficient and work well, the drive nuts and rollers used on such bearing assemblies are quite expensive. There is thus a need for a bearing assembly that will rotate a spiral wand, as disclosed in my U.S. Pat. No. 5,476,132 patent, in an efficient and easily operated manner that are less costly and cheaper to manufacture than the bearing assemblies disclosed in my U.S. Pat. No. 5,476,132 patent.

SUMMARY OF THE INVENTION

It is an object of this invention to provide cordless apparatus for raising and lowering shades and blinds.

It is an object of this invention to provide cordless apparatus for rotating vertical louvers and horizontal slats, as well as traversing vertical blinds using bearing assemblies engaging a spiral wand which are inexpensive to manufacture.

These and other objects are preferably accomplished by providing a pair of actuators in spiral engagement with a spiral wand coupled to rail mechanism from which blinds or shades depend. One of the actuators rotates the wand in one direction and the other actuator rotates the wand in an opposite direction. Raising or lowering selective actuators operates the blinds or shades. Each actuator includes a bearing assembly having a drive nut portion having a throughbore conforming to the flutes of the spiral wand and a toothed exterior adapted to engage a flange on the interior of the actuator housing to drive the same.

BRIEF DESCRIPTION OF THE DRAWINGS

FIG. 3 is a view taken along lines 3—3 of FIG. 2, the spring being omitted for convenience of illustration;

FIG. 4 is a view taken along lines 4—4 of FIG. 2;

FIG. 5 is a view similar to the view of FIG. 2 illustrating the operation thereof;

DESCRIPTION OF THE PREFERRED EMBODIMENT

Figure 1:
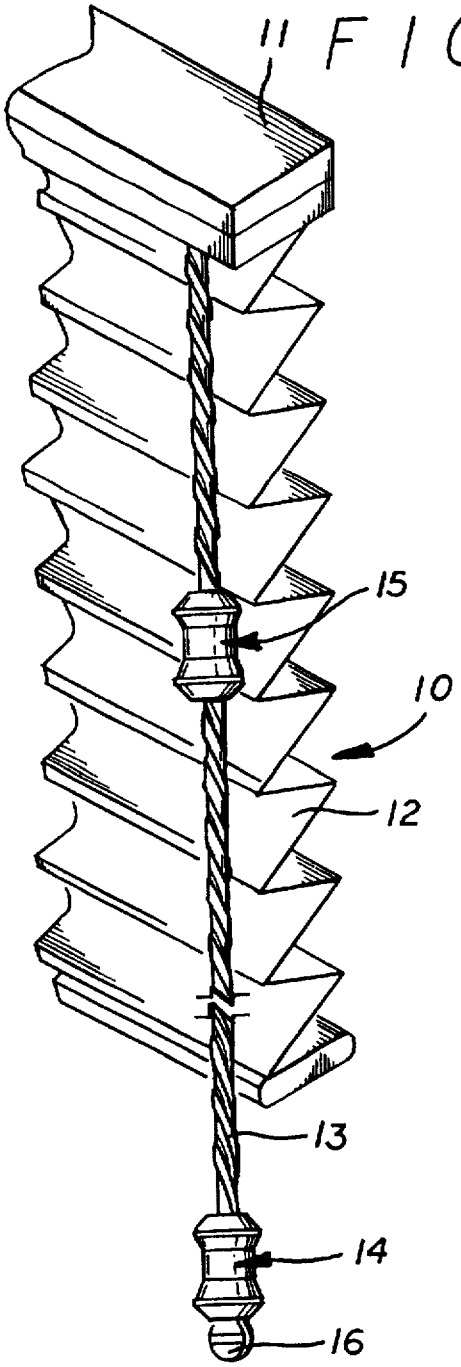
FIG. 1 is a perspective view of a portion of a horizontal shade assembly having a spiral wand and a pair of actuators mounted thereon in accordance with the teachings of the invention.

Referring now to FIG. 1 of the drawing, a portion of a conventional horizontal blind or shade assembly 10 is shown having an upper rail assembly 11 from which a plurality of horizontally disposed and vertically spaced interconnected shades 12 or slats or any covering depend. Although the invention will be described herein with respect to raising, lowering, or tilting of horizontal shades or blinds, the teachings are applicable to the opening, closing, or rotating of vertical blinds as will be discussed.

Thus, a spiral wand 13 extends downwardly from rail assembly 11 and has a plurality, such as two, of actuators 14, 15 disposed thereon. A terminal stop 16 is provided at the bottom of wand 13.

Figure 2:
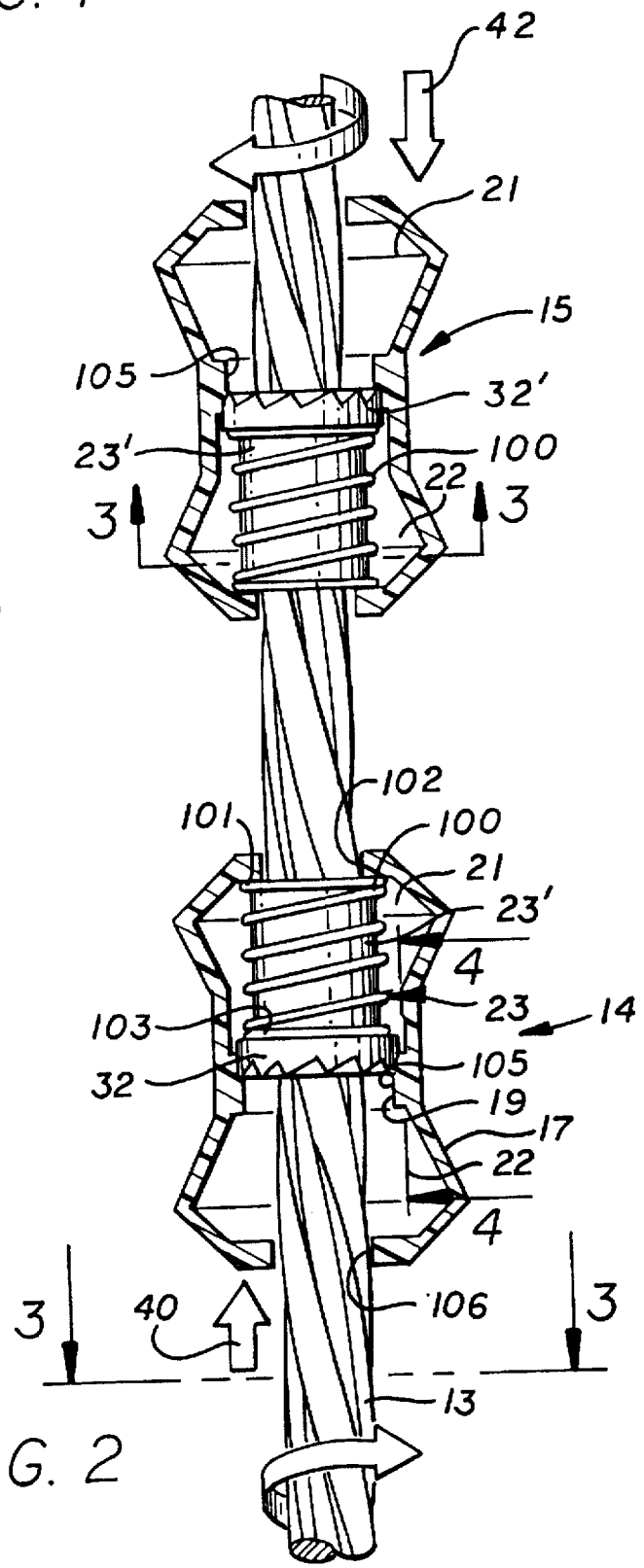
FIG. 2 is an elevational view, partly in section, of a portion of the wand and actuators of the assembly of FIG. 1.

Spiral wand 13 and actuators 14, 15 are shown in detail in FIG. 2. Each actuator 14, 15 is essentially identical except as will be discussed. Thus, actuator 14 is comprised of a main housing through which wand 13 passes. Each housing also has an inner chamber, as chambers 21, 22, respectively, which serve to retain therein a single directional locking bearing assembly 23.

Bearing assembly 23 includes a generally cylindrical main body portion 23' having an integral drive nut portion 32, also cylindrical on its exterior and of a greater outer diameter than main body portion 23'. As seen in FIG. 3, bearing assembly 23 is internally configured similarly to the spiral grooves and ridges of wand 13. Thus, assembly 23 has a central throughbore with spiral ridges 35 and valleys 36 conforming to the spiral ridges 37 and valleys 38 on the exterior of wand 13.

A coiled spring 100 (FIG. 2) is coiled about the exterior of main body portion 23'. The upper coil 101 abuts against the area surrounding hole 102 in housing 17 through which wand 13 passes. The lower coil 103 abuts against drive nut portion 32. Drive nut portion 32 is a toothed wheel having a throughbore configured to the outer ridges and valleys 35, 36 respectively, of wand 13. Drive nut portion 32 is stopped in its downward movement within housing 17 by its engagement with a flange 40 (FIG. 4) integral with peripheral flange 19 (FIG. 2) engaging the notches of the toothed wheel as seen in FIG. 4. Wand 13 passes downwardly through opening 106 in housing 17.

It is to be understood that housing 17 may be molded of a single piece or parts joined together in any suitable manner. It is also to be understood that actuator 15 is identical to actuator 14 except that drive nut portion 32', FIG. 2, otherwise identical to drive nut portion 32, has its toothed end reversed therein as shown with flange 105' reversed from flange 40 and spring 100 extending about drive nut portion 32' below the toothed end thereof. Either chamber 22 or 21 may be used as long as flange 40 (FIG. 4) is provided in the chamber.

In operation, as seen in FIGS. 2 and 4, when actuator 14 is moved upwardly on wand 13 in the direction of arrow 40, flange 40 engages drive nut portion 32 spinning wand 13 thus lowering the shades or blinds 12. Spring 100 biases drive nut portion 32 into engagement with flange 105 and thus into driving engagement with wand 13. When actuator 14 is moved downwardly, as seen in FIG. 5, in the direction of arrow 41, wand 13 merely passes through actuator 14.

If it is desired to raise the shades or blinds 12, actuator 15 is first raised upwardly on wand 13 in the direction opposite that of arrow 42 in FIG. 2. Wand 13 merely slips through bearing assembly 23'. However, when actuator 15 is moved downwardly in the direction of arrow 42, flange 105''' engages drive nut portion 32' to rotate wand 13 due to its driving engagement with the ridges and valleys 35, 36 of wand 13. This raises shades or blinds 12.

Nut portions 32, 32' are always in spiral engagement with wand 13 but selectively driven by engagement with flanges 40, as heretofore discussed.

Figure 7:
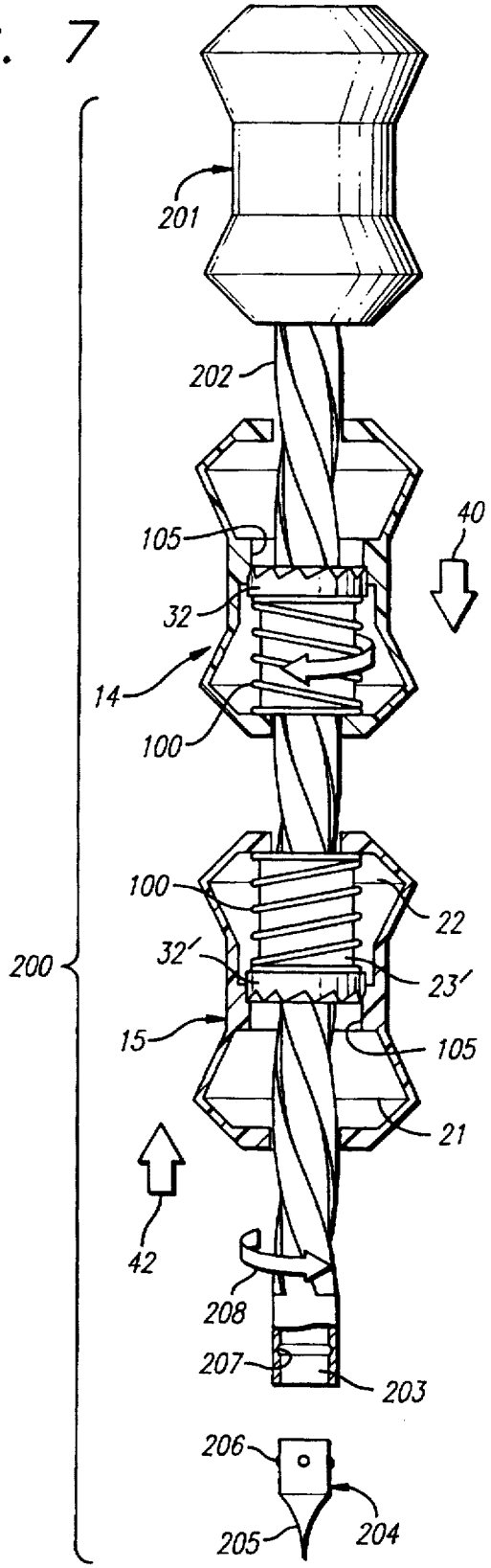
FIG. 7 is a view similar to FIG. 6 showing a modification of the screwdriver of FIG. 6.

It can be seen, by reference to FIG. 7 of my U.S. Pat. No. 5,476,132, and the description therein, the teachings of which are incorporated herein by reference, vertical shades or blinds can be opened and closed by providing a pair of wands, each wand having a pair of actuators in accordance with the teachings herein.

In manufacture of wand 13, wand 13 can be cold-extruded to the fluted configuration shown after twisting and pulling the same while cold. As seen in FIG. 3, the pitch of the spirals and grooves of wand 13 may be varied to control the speed and torque desired. For example, a heavier blind would be used with a slower pitch thereby reducing the torque required to lift the shade or blind. The wand herein, as shown in FIG. 3, has an infinite varying pitch.

Although any suitable dimensions may be used, as seen in FIG. 3, angle a may be about 120°. Angle b may be about 60°. D2 may be about 0.160". Dl may be about 0.312". R1 may be about 0.010". R2 may be about 0.010". These are preferred dimensions but again may be varied. Bearing assemblies 23, 23' may be similarly internally configured as may be toothed drive nut portions 32, 32'.

As in my U.S. Pat. No. 5,476,132, the invention herein eliminates potentially dangerous cords and is safe and easy to use. There are no tangled piles of cords to deal with and the apparatus is easy to raise, lower, and position the shade or blind at the exact height desired.

Shades and blinds glide open and closed evenly; shades and blinds stay level. The apparatus herein raises heavy blinds with less effort than with the cords and the shades stop exactly where one releases the operator. The apparatus allows one to set the shades or blinds at the same level as adjacent shades or blinds.

For vertical shades or blinds, there is no need to guess which cord does what function. Each wand and actuator's function is clearly identifiable. The wands and operators, for example, although made of any suitable materials, may be differentiated for ease of identification by making one wand of clear plastic and the other wand of steel or other suitable materials. Contrasting colors may be also be used. The clear wand, using one actuator, may be for rotating the louvers; the steel wand, with two actuators, may be for traversing the blinds open and closed.

Figure 6:
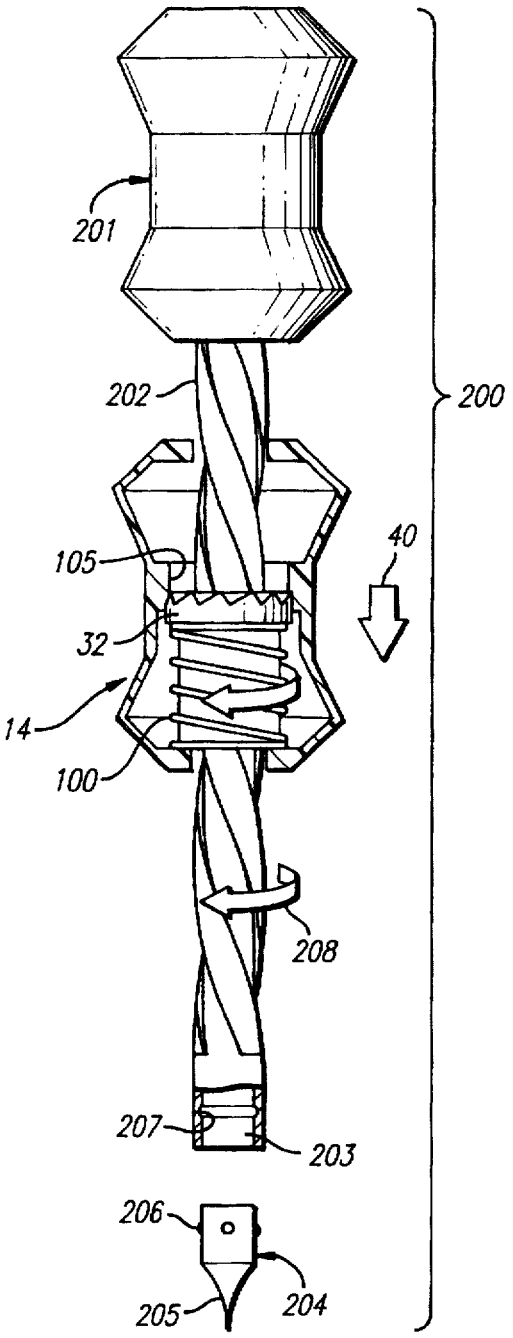
FIG. 6 is an exploded elevational view, partly in section, of a screwdriver utilizing the teachings of the invention.

Although the actuating means has particular application to the operation of blinds or shades, the concept of using an elongated spiral wand and the actuating means can be applied in other applications. For example, as seen in FIG. 6, wherein like numerals refer to like parts of the embodiment of FIGS. 1 to 5, a screwdriver 200 is shown having a handle portion 201 at one end and spiral shaft 202, identical in cross-section above handle portion 201 and below and along actuator 14 to wand 13, fixed thereto.

Actuator 14, its interior mechanism, and its mechanical engagement with shaft 202, is identical to the structure and operation of actuator 14 in FIG. 5.

Shaft 202 terminates at its lower end in a socket 203 adapted to receive therein a removable screwdriver blade 204. Blade 204 has a tapered or sharp tip 205 for engaging the slot of a screw or the like (not shown). A simple ball lock arrangement, as balls 206 on blade 204 and bead 207 on the inner wall of socket 203, may be used to remove blade 204 and substitute another.

In operation, the user inserts blade 204 into socket 203 wherein balls 206 move inwardly into the body of blade 204 when they engage bead 207, as is well known in the ball lock art, then snap back to prevent easy withdrawal therefrom. Of course, as is well known in the art, sufficient force is used to move balls 206 back into the body of blade 204 past bead 207 when it is desired to replace blade 204.

The user then grasps handle portion 201 and inserts tip 205 into the slot of a screw or the like. When actuator 14 is moved downwardly on shaft 202 in the direction of arrow 40, flange 105 engages drive nut portion 32 spinning shaft 202 and thus rotating tip 205 in the clockwise direction of arrow 208 thus driving a screw or the like in engagement with tip 205. Moving actuator 14 upwardly on shaft 202 in the direction opposite arrow 40 merely allows shaft 202 to pass through actuator 14.

If desired, a second actuator, such as actuator 15 in FIG. 2, may be provided on shaft 202 in like manner for rotating shaft 202 in a direction opposite arrow 208. This is seen in FIG. 7 wherein like numerals refer to like parts of the embodiment of FIG. 6, along with actuator 15 of FIG. 2. Operating actuator 15 thus spins shaft 202 in a direction opposite actuator 14 thus unscrewing a screw or the like.

When you pull down on the upper actuator you can raise a blind as in FIGS. 1 to 5; when you push up on the lower actuator, you lower the blind. This can be reversed; however, tensile forces acting on the wand are such that this procedure is desirable, particularly for raising the blind.

Thus, the concepts of my invention can have many applications where one desires to rotate a shaft such as in the screwdrivers of FIGS. 6 and 7.

The actuators disclosed herein can be turned upside down and cause the respective shafts or wands to spin in the other direction. This makes the combination of the wands and actuators quite versatile and useful in many applications.

Although specific embodiments of the invention have been disclosed, variations thereof may occur to an artisan and the scope of the invention should only be considered limited by the scope of the appended claims.

I claim:

1. Apparatus for operating horizontal blinds or shades and vertical blinds comprising:

actuating means coupled to said blinds or shades for selectively moving the same;

a substantially vertically extending elongated spiral wand having elongated grooves and ridges coupled to said actuating means having a plurality of actuators in spiral engagement therewith, one of said actuators being disposed above the other and each actuator having a one-way bearing assembly mounted therein, the bearing assembly in one actuator rotating in a direction opposite that of the bearing assembly in the other actuator, each of said bearing assemblies being in driving engagement with at least one drive nut encircling said wand and in spiral engagement therewith whereby movement of one actuator along said wand rotates said wand in one direction and movement of the other actuator along said wand rotates said wand in a direction opposite that of the said one actuator, each of said bearing assemblies including a main body portion having a throughbore encircling said wand having elongated grooves and ridges on its throughbore conforming to the grooves and ridges of said wand, each of said bearing assemblies further including a drive nut portion also having a throughbore with elongated grooves and ridges therein conforming to the grooves and ridges of said wand and also having a toothed exterior adapted to engage a flange on the inner wall of said main body portion to drive the same, and biasing means mounted on each of said bearing assemblies biasing said drive nut portions into engagement with said flange.

2. In the apparatus of claim 1 wherein said biasing means is a coiled spring encircling said main body portion engaging said drive nut portion.

3. In the apparatus of claim 1 wherein each of said actuators has a main housing having upper and lower ends open at said ends receiving said wand therethrough, each of said housings being divided into an upper chamber and a lower chamber separated by a peripheral inner flange having said first mentioned flange thereon, the bearing assemblies of one actuator being mounted in the upper chamber and the bearing assembly of the other actuators being mounted in the lower chamber thereof, each of said bearing assemblies having their respective drive nut portion adapted to abut against said first mentioned flange.

4. In the apparatus of claim 3 wherein said biasing means of each of said actuators abuts at one end against the drive nut portion mounted therein and the other end against the drive nut portion mounted therein and at the other end against the inner area of said housing where said wand passes therethrough.

5. In the apparatus of claim 4 wherein said biasing means is a coiled spring surrounding said main body portion, one of the coils thereof abutting against said housing inner area and another coil thereof abutting against said drive nut portion.

6. In the apparatus of claim 1 wherein said main housing portion of each said actuators is integral with said drive nut portion.

7. In the apparatus of claim 1 wherein both said drive nut portion and said main body portion have an outer diameter and said drive nut portion outer diameter is greater than said main body portion outer diameter.

8. Apparatus for operating horizontal blinds or shades and vertical blinds comprising:

actuating means coupled to said blinds or shades for selectively moving the same;

an elongated spiral wand having a plurality of elongated spiral grooves and ridges coupled to said actuating means having an actuator in spiral engagement therewith, said actuator having drive nut means mounted therein in driving engagement with said wand being adapted to rotate said wand in a single direction when said actuator is moved along said wand in one direction and to allow said wand to slide within said actuator without rotating said wand when said actuator is moved along said wand in a direction opposite said one direction, said drive nut means being biased into driving engagement with said wand by resilient means engaging said drive nut means and said actuator when said actuator is moved in said one direction.

9. In the apparatus of claim 8 wherein said drive nut means includes a toothed portion having a throughbore with grooves and ridges conforming to the grooves and ridges of said wand and in engagement therewith, said actuating means including a flange adapted to engage said toothed portion to rotate the same.

10. In the apparatus of claim 8 including a second actuator in spiral engagement therewith, said second actuator having drive nut means mounted therein in driving engagement with said wand being adapted to rotate said wand in a direction opposite said single direction when said actuator is moved along said wand in one direction and to allow said wand to slide within said actuator without rotating said wand when said actuator is moved along said wand in a direction opposite said last-mentioned one direction, said drive nut means of said second actuator being biased into driving engagement when said wand when said actuator is moved in said one direction.

11. In the apparatus of claim 10 wherein said drive nut means of said second actuator includes a toothed portion having a throughbore with grooves and ridges conforming to the grooves and ridges of said wand and in engagement therewith, said actuator means including a flange adapted to engage said toothed portion to rotate the same.

12. Apparatus for operating horizontal blinds or shades and vertical blinds comprising:

actuating means coupled to said blinds or shades for selectively moving the same;

an elongated spiral wand having a plurality of elongated spiral grooves and ridges coupled to said actuating means having an actuator in spiral engagement therewith, said actuator having drive nut means mounted therein in driving engagement with said wand being adapted to rotate said wand in a single direction when said actuator is moved along said wand in one direction and to allow said wand to slide within said actuator without rotating said wand when said actuator is moved along said wand in a direction opposite said one direction, said drive nut means being biased into driving engagement with said wand when said actuator is moved in said one direction, said drive nut means including a toothed portion having a throughbore with grooves and ridges conforming to the grooves and ridges of said wand and in engagement therewith, said actuating means including a flange adapted to engage said toothed portion to rotate the same.

13. In the apparatus of claim 12 including a second actuator in spiral engagement therewith said second actuator having drive nut means mounted therein in driving engagement with said wand being adapted to rotate said wand in a direction opposite said single direction when said actuator is moved along said wand in one direction and to allow said wand to slide within said actuator without rotating said wand when said actuator is moved along said wand in a direction opposite said last-mentioned one direction, said drive nut means of said second actuator being biased into driving engagement with said wand when said actuator is moved in said one direction.

14. Apparatus for operating horizontal blinds or shades and vertical blinds comprising:

actuating means coupled to said blinds or shades for selectively moving the same;

an elongated spiral wand having a plurality of elongated spiral grooves and ridges coupled to said actuating means having an actuator in spiral engagement therewith, said actuator having drive nut means mounted therein in driving engagement with said wand being adapted to rotate said wand in a single direction when said actuator is moved along said wand in one direction and to allow said wand to slide within said actuator without rotating said wand when said actuator is moved along said wand in a direction opposite said one direction, said drive nut means being biased into driving engagement with said wand when said actuator is moved in said one direction;

a second actuator, said second actuator having drive nut means mounted therein in driving engagement with said wand being adapted to rotate said wand in a direction opposite said single direction when said second actuator is moved along said wand in one direction and to allow said wand to slide within said second actuator without rotating said wand when said second actuator is moved along said wand in a direction opposite said last-mentioned one direction, said drive nut means of said second actuator being biased into driving engagement with said wand when said second actuator is moved in said one direction, said drive nut means of said second actuator including a toothed portion having a throughbore with grooves and ridges conforming to the grooves and ridges of said wand and in engagement therewith, said second actuator including a flange adapted to engage said toothed portion to rotate the same.

* * * * *